US010207306B2

(12) United States Patent
Sasaki et al.

(10) Patent No.: US 10,207,306 B2
(45) Date of Patent: Feb. 19, 2019

(54) METHOD FOR PROCESSING GALVANIZED COMPONENT

(71) Applicant: NISSHIN STEEL CO., LTD., Tokyo (JP)

(72) Inventors: Hirokazu Sasaki, Sakai (JP); Jun Kurobe, Tokyo (JP)

(73) Assignee: NISSHIN STEEL CO., LTD., Tokyo (JP)

( * ) Notice: Subject to any disclaimer, the term of this patent is extended or adjusted under 35 U.S.C. 154(b) by 0 days.

(21) Appl. No.: 15/505,668

(22) PCT Filed: Aug. 22, 2014

(86) PCT No.: PCT/JP2014/004342

§ 371 (c)(1),
(2) Date: Feb. 22, 2017

(87) PCT Pub. No.: WO2016/027293

PCT Pub. Date: Feb. 25, 2016

(65) Prior Publication Data

US 2017/0266708 A1 Sep. 21, 2017

(51) Int. Cl.
*B21D 22/20* (2006.01)
*C23C 2/06* (2006.01)
(Continued)

(52) U.S. Cl.
CPC ..... *B21D 22/20* (2013.01); *C21D 7/02* (2013.01); *C23C 2/06* (2013.01); *C23C 2/26* (2013.01); *C21D 2251/02* (2013.01)

(58) Field of Classification Search
CPC ..... B21D 22/20; B21D 22/24; C23C 2/14; C23C 2/26; C21D 7/02; C21D 2251/02
See application file for complete search history.

(56) References Cited

U.S. PATENT DOCUMENTS

2012/0186705 A1 7/2012 Sikora
2017/0043386 A1 2/2017 Nakagaito et al.

FOREIGN PATENT DOCUMENTS

| | | | | |
|---|---|---|---|---|
| EP | 2495352 A1 | | 9/2012 | |
| EP | 3135394 A1 | | 3/2017 | |
| JP | 01079382 A | * | 3/1989 | ..... C25D 5/10 |
| JP | H02175007 A | | 7/1990 | |
| JP | 2004149850 A | | 5/2004 | |
| JP | 2007327104 A | | 12/2007 | |

(Continued)

OTHER PUBLICATIONS

Translated WIPO written Opinion of PCT/JP2014/004342; dated Nov. 18, 2014.*

(Continued)

*Primary Examiner* — Pradeep C Battula
(74) *Attorney, Agent, or Firm* — Lucas & Mercanti, LLP

(57) ABSTRACT

The present invention suppresses deterioration in the corrosion resistance of a worked portion resulting from working cracks in a Zn-based plated layer (3) in a workpiece (2) formed into a predetermined shape by performing plastic working on a Zn-based plated steel sheet (1) coated with a Zn-containing metal as a raw material. That is, plastic working is performed on a raw material that is a Zn-based plated steel sheet (1) to obtain a workpiece (2) having a predetermined shape, and thereafter, pressurization processing is performed on a worked portion in a sheet thickness direction to deform the plated metal, thus decreasing the width of working cracks in the plated metal. Accordingly, it is possible to reduce the deterioration in the corrosion resistance of the worked portion of the Zn-based plated workpiece.

2 Claims, 4 Drawing Sheets

(51) Int. Cl.
*C23C 2/26* (2006.01)
*C21D 7/02* (2006.01)

(56) References Cited

FOREIGN PATENT DOCUMENTS

| | | | |
|---|---|---|---|
| JP | 2009-082992 | A | 4/2009 |
| JP | 4919427 | B2 | 2/2012 |
| KR | 10-2014-0081623 | A | 7/2014 |
| MX | 2016013666 | A | 1/2017 |

OTHER PUBLICATIONS

Translation of JP 2004-149850 from JPO; Sep. 2018.*
Translation of JP 2007-327104 from JPO; Sep. 2018.*
Office Action dated Mar. 1, 2018 from the corresponding Korean Patent Application No. 10-2017-7004779.
European Search Report dated Jul. 28, 2017 from corresponding European Application No. 14900014.3.
European Office Action dated Sep. 4, 2017 from corresponding European Application No. 14900014.3.
International Search Report dated Nov. 18, 2014 for Application No. PCT/JP2014/004342 and English translation.
Office Action dated Jul. 13, 2018 from corresponding Chinese Patent Application No. CN 201480081394.6.
"Section VII Pressure processing repair method", Foundation for Operation and Repair of Vehicle Tractor, Department of Agricultural Machinery, Tsinghua University, Zhenjiang Agricultural Machinery College, p. 299, with publication date of Dec. 31, 1961, and an English translation.

* cited by examiner

METHOD FOR PROCESSING GALVANIZED COMPONENT

CROSS REFERENCE TO RELATED APPLICATION

This Application is a 371 of PCT/JP2014/004342 filed on Aug. 22, 2014, application which is incorporated herein by reference.

TECHNICAL FIELD

The present invention relates to an improvement of a method for processing a Zn-based plated component, in which plastic working is performed on a Zn-based plated steel sheet coated with a Zn-containing metal as a raw material to form a workpiece (i.e., a Zn-based plated component) having a predetermined shape.

BACKGROUND ART

Conventionally, it has been common to perform plastic working on a cold-rolled steel sheet to form a shape having predetermined dimensions, and thereafter perform Zn plating (post-Zn plating) to produce a component. However, for the recent automobile components, home electrical appliances and the like, for the purpose of enhancing corrosion resistance and durability of the component, and achieving cost reduction by omission of steps, it is increasingly the case that a Zn-based plated steel sheet obtained by coating Zn or a Zn alloy on a steel sheet is used as a raw material, and a component is produced by performing plastic working on the steel sheet.

As used herein, a steel sheet obtained by plating Zn or a Zn-containing alloy on the surface of a steel sheet is referred to as a Zn-based plated steel sheet.

Here, the plated layer of the Zn-based plated steel sheet is inferior in ductility to the underlying steel sheet, and therefore, cracks may occur in the plated layer when plastic working is performed on the plated steel sheet used as the raw material. In general, the cracks in the plated layer are more prominent in bulging processing in which a stronger tensile stress is likely to be exerted on the plated layer than in drawing processing. Then, when such cracks in the plated layer, or in other words, working cracks occur, the plated layer is divided. As a result, the underlying steel sheet is exposed from the gaps between the divided plated layers, which may lead to deterioration in the corrosion resistance of the workpiece. When the plated layer is a Zn-based plated layer and the degree of working cracks is slight, deterioration in the corrosion resistance is inconspicuous because of the sacrificial protection effect of the Zn-based plated layer even if the underlying steel sheet is exposed. However, when the degree of the working cracks is significant, red rust occurs from the exposed portion of the underlying steel sheet to degrade the external appearance, or corrosion advances from the exposed portion of the underlying steel sheet to reduce the thickness of the underlying steel sheet, which may cause a decrease in the strength of the workpiece.

Therefore, as a method for suppressing the deterioration in the corrosion resistance of the worked portion, it is possible to use, as a raw material, a Zn—Al—Mg-based plated steel sheet coated with a Zn—Al—Mg-based alloy having excellent corrosion resistance. However, this cannot prevent working cracks, so that it is difficult to prevent the occurrence of red rust.

As a processing method capable of suppressing working cracks in the plated layer, PTL 1 discloses a processing method in which a Zn-based plated steel sheet is heated and held in a temperature range of not less than 50° C. and not more than 150° C., to process the Zn-based plated steel sheet into a target shape. This processing method is intended to heat and hold the Zn-based plated steel sheet so as to apply processing to the plated layer in a state in which the ductility thereof is increased, thereby suppressing working cracks (cracks) in the plated layer.

CITATION LIST

Patent Literature

[PTL 1] Japanese Patent No. 4919427

SUMMARY OF INVENTION

Technical Problem

However, with the processing method of PTL 1, the plated layer cannot follow the plastic deformation of the underlying steel sheet unless the elongation percentage is limited to less than 20%, so that the area percentage of working cracks (cracks) exceeds 5%. In addition, this method requires preparation of a heating device, so that the problem of an increased cost for investment in plant and equipment arises. Furthermore, a heating time for heating the Zn-based plated steel sheet to a certain temperature is required. This reduces the production efficiency, and the resulting cost increase is inevitable.

Therefore, it is an object of the present invention to provide a processing method of a workpiece that uses a Zn-based plated steel sheet as a raw material, and that can enhance the corrosion resistance of the workpiece by reducing the occurrence of red rust resulting from working cracks in a plated layer, without introducing a significant investment in plant and equipment or deterioration in the production efficiency.

Solution to Problem

To solve the object, a processing method according to the present invention further performs, after performing plastic working on a Zn-based plated steel sheet 1 as a raw material to produce a workpiece 2 having a predetermined shape, pressurization processing by applying reduction to the worked portion in a sheet thickness direction such that a plated layer 3 is rolled.

When reduction is applied in the sheet thickness direction to the plated layer 3 suffering from working cracks 4 caused by plastic working to perform pressurization processing such that the plated layer 3 is rolled, the plated layer 3 collapses in the sheet thickness direction and expands in the in-plane direction of the plated layer 3. As a result, the interval between the plated layers 3 adjacent to each other via a gap formed by the working cracks 4 is narrowed, which facilitates the sacrificial protection function of the Zn-based plated metal and suppresses the deterioration in the corrosion resistance of the workpiece 2.

The reduction in the sheet thickness direction for the purpose of performing pressurization processing on the plated layer 3 needs to apply a stress sufficient to allow the plated layer 3 to expand in the in-plane direction, or in other words, to allow the plated layer 3 to be rolled. Accordingly, as long as such a stress can be applied, the reduction can be performed for a plurality of times in a divided manner depending on the shape of the worked portion, or may be performed also as restriking (additional working) for finishing the workpiece 2 into a predetermined shape that is more accurate.

Advantageous Effects of Invention

With the processing method of the Zn-based plated component according to the present invention, the interval between the plated layers adjacent via a gap formed by working cracks is narrowed, which facilitates the sacrificial protection function of the Zn-based plated metal and suppresses deterioration in the corrosion resistance of the workpiece. That is, applying reduction to the plated layer in the sheet thickness direction can achieve the same effect as that is achieved by a reduced level of the working cracks in the plated layer.

In addition, when a Zn—Al—Mg-based plated steel sheet coated with a Zn—Al—Mg-based alloy having excellent corrosion resistance is used as the raw material, the sacrificial protection effect is exerted further strongly, so that it is possible to enhance the ability to suppress the occurrence of red rust.

Accordingly, it is possible to provide a processing method of a workpiece that uses a Zn-based plated steel sheet as a raw material, and that can enhance the corrosion resistance of the workpiece by reducing the occurrence of red rust resulting from the working cracks in the plated layer, without introducing a significant investment in plant and equipment or deterioration in the production efficiency.

BEST MODE FOR CARRYING OUT THE INVENTION

Hereinafter, an embodiment of the present invention will be described in detail with reference to the drawings.

Figure 1:
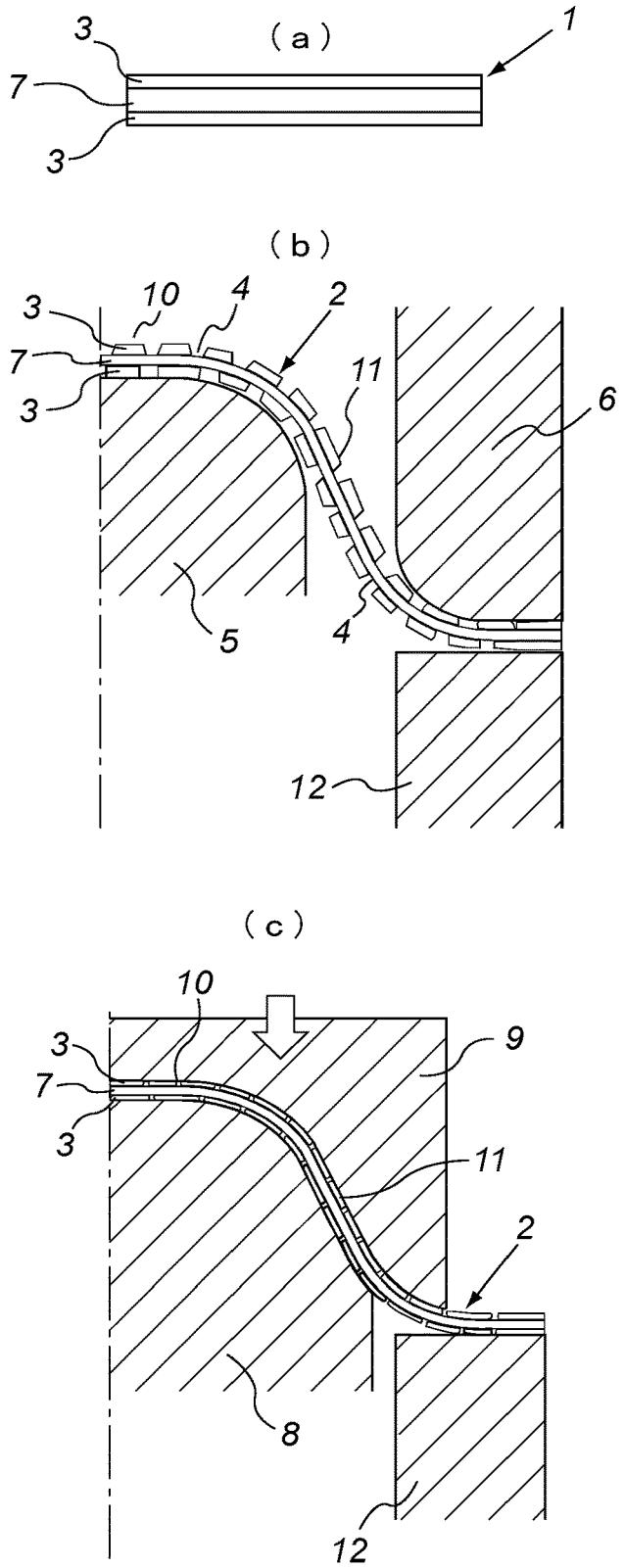
FIG. 1 shows schematic cross-sectional views showing exemplary processing steps used by a processing method according to the present invention, wherein (a) shows a raw material before processing, (b) shows plastic working into a predetermined shape, and (c) shows pressurization processing on a worked portion in a sheet thickness direction.

In FIG. 1, (a) is a diagram schematically showing a cross section of a Zn-based plated steel sheet 1 before processing. Since the Zn-based plated steel sheet 1 is in a state before plastic working, a plated layer 3 has not yet undergone working cracks, and, as shown in this drawing, the surface of an underlying steel sheet 7 is covered with the plated layer 3.

In FIG. 1, (b) shows a step of performing plastic working on a Zn-based plated steel sheet 1 by using a punch 5, a die 6, and a blank holder 12 to produce a workpiece 2 having a predetermined shape. At this time, irregular working cracks 4 occur in the plated layer 3. Since plastic working tends to exert a stronger tensile stress on the plated layer 3 in bulging processing than in drawing processing, the working cracks 4 in the plated layer 3 tend to be prominent. Also, the depth or width of the working cracks 4 increases with an increase in the degree of processing of plastic working, for example, an increase in the bulging height. Then, when the interval between adjacent working cracks 4 is widened to increase the exposure of the underlying steel sheet 7 from the surface, red rust occurs from the underlying steel sheet 7, resulting in deterioration in the corrosion resistance of the workpiece 2. The reason for this is that the interval between the working cracks 4 is widened beyond the extent of the sacrificial protection effect of the plated metal.

To make the interval between the working cracks 4 small, in the present invention, reduction is applied to the worked portion in the sheet thickness direction by using a pressurization punch 8 and a pressurization die 9, as shown in (c) of FIG. 1 as an example. This causes the plated layer 3 to undergo plastic deformation so as to be rolled in the in-plane direction of the underlying steel sheet 7. As a result, the interval between the working cracks 4 in the plated layer 3 is narrowed, so that the occurrence of red rust is suppressed by the sacrificial protection effect of the plated metal around the working cracks 4.

Regarding the pressurization using the pressurization punch 8 and the pressurization die 9, pressurization for simply deforming the plated layer 3 may be performed when the workpiece 2 has been finished into a predetermined shape, and the shape of the workpiece 2 itself will not be changed. In the case of restriking the workpiece 2 so as to be finished into a predetermined shape, pressurization processing on the plated layer 3 can also be performed simultaneously with the restriking.

The use of a Zn—Al—Mg-based plated steel sheet, which is a plated steel sheet coated with a plated metal containing Zn, Al and Mg, as the Zn-based plated steel sheet 1 can further enhance the sacrificial protection effect. With the Zn—Al—Mg-based plated steel sheet, when the underlying steel sheet 7 is exposed by the working cracks 4, the plated metal around the working cracks 4 is eluted, and the eluted components cause a dense Zn corrosion product containing Mg to cover the underlying steel sheet 7 around the working cracks 4, thereby suppressing corrosion. The Mg-containing Zn corrosion product has a higher protective performance than the Zn corrosion product of the Zn-plated steel sheet, and thus can achieve a stronger sacrificial protection effect.

EXAMPLES

Hereinafter, the present invention will be described more specifically by way of examples. However, the present invention is not limited to the examples.

Using a Zn—Al (6 wt %)—Mg (3 wt %) alloy-plated steel sheet having a sheet thickness of 1.2 mm and a plating deposition amount per side of 140 g/m$^2$ as a raw material, bulging processing and pressurization on the worked portion were performed by the steps shown in FIG. 1.

The punch 5 used for the bulging processing has a columnar shape having a diameter of 200 mm and a shoulder portion having a radius of curvature of 10 mm. Meanwhile, the die 6 has an inner diameter of 203 mm and a shoulder portion having a radius of curvature of 10 mm. The blank holder 12 has an inner diameter of 202 mm. Then, as shown in (b) of FIG. 1, a bulged workpiece 2 having an inner diameter of 200 mm and a height of 40 mm was made by using the punch 5, the die 6, and the blank holder 12.

Then, pressurization processing was performed on a worked portion of the workpiece 2. As shown in (c) of FIG. 1, this pressurization processing was performed by using the pressurization punch 8, the pressurization die 9, and the blank holder 12. The shapes of the pressurization punch 8 and the pressurization die 9 were the same as the shapes of a head portion 10 and a vertical wall portion 11 of the workpiece 2.

Then, the pressurization force of the pressurization processing was set to three levels, namely, 30 kN, 40 kN, and 60 kN, and the pressurization direction was set to a direction from up to down on the paper plane relative to the head portion 10 of the workpiece 2, as indicated by the outlined arrow shown in (c) of FIG. 1.

Here, in (c) of FIG. 1, the head portion 10 is perpendicular to the direction of the outlined arrow, so that the pressurization force itself acts as "force of applying reduction in the sheet thickness direction". However, at the vertical wall portion 11, which is slightly inclined relative to the direction of the outlined arrow, the pressurization force indicated by the outlined arrow is decomposed into "component force perpendicular to the wall surface of the vertical wall portion 11" and "component force parallel to the wall surface of the vertical wall portion 11". Accordingly, at the vertical wall portion 11, "force of applying reduction in the sheet thickness direction" is slightly lowered than that acting on the head portion 10. However, the shapes of the pressurization punch 8 and the pressurization die 9 are the same as the shape of the vertical wall portion 11 of the workpiece 2, so that "component force parallel to the wall surface of the vertical wall portion 11" acts such that the plated layer 3 on the surface of the vertical wall portion 11 is expanded in the in-plane direction. As a result, the interval between the working cracks 4 in the plated layer 3 at the vertical wall portion 11 also can be narrowed to substantially the same level as that at the head portion 10.

Figure 2:
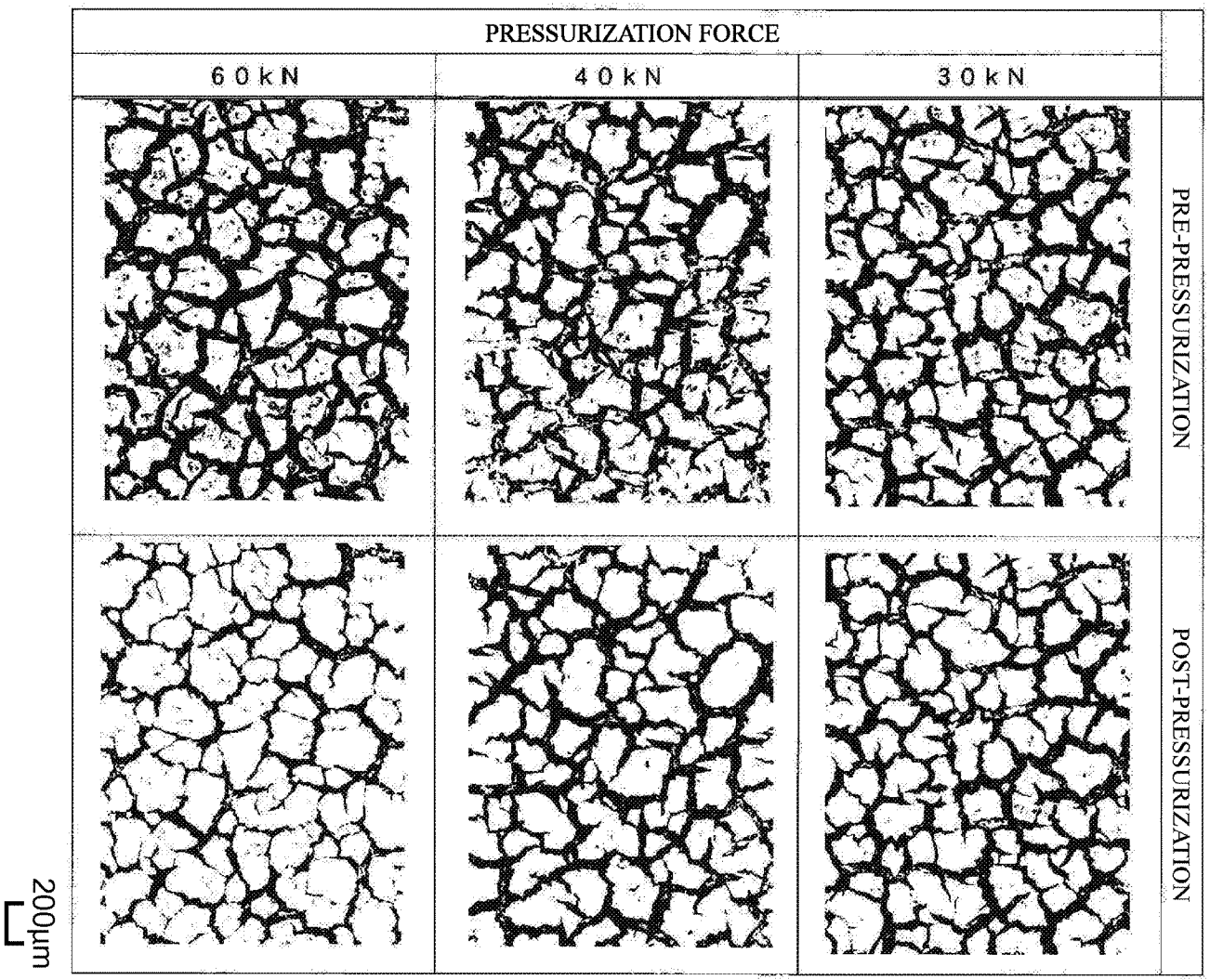
FIG. 2 shows images as substitutes for drawings wherein "pre-pressurization" shows states of working cracks in a plated layer that have occurred in a worked portion, as observed from the surface of the worked portion, and "post-pressurization" shows states of the working cracks after pressurization processing in which reduction has been applied to the worked portion in the sheet thickness direction.

The states of the working cracks in the plated layer 3 in the above-described pressurization processing before and after pressurization are shown in FIG. 2. FIG. 2 shows photographs obtained by photographing, at a magnification of 200× by an optical microscope, the state of the head portion 10 of the workpiece 2 before pressurization and the states of working cracks in the plated layer 3 on the same portion after being pressurized with the respective pressurization forces. Although no reference numeral is provided in FIG. 2, the white portions in the drawing show the plated layer 3, and the black portions in the drawing show portions where the underlying steel sheet 7 is exposed by the working cracks 4.

It can be seen in the drawing that, as a result of performing pressurization processing, the interval between adjacent working cracks 4 in the plated layer 3 has been narrowed.

In addition, before and after performing pressurization of the worked portion, the state of the working cracks 4 in the plated layer 3 at the head portion 10 of the workpiece 2 was observed at a magnification of 200× by an optical microscope, and the area ratio (=the underlying steel sheet exposure percentage) of the area in which the underlying steel sheet 7 was exposed by the working cracks 4 in the plated layer 3 relative to an observed area of 5 $mm^2$ was evaluated.

Figure 3:
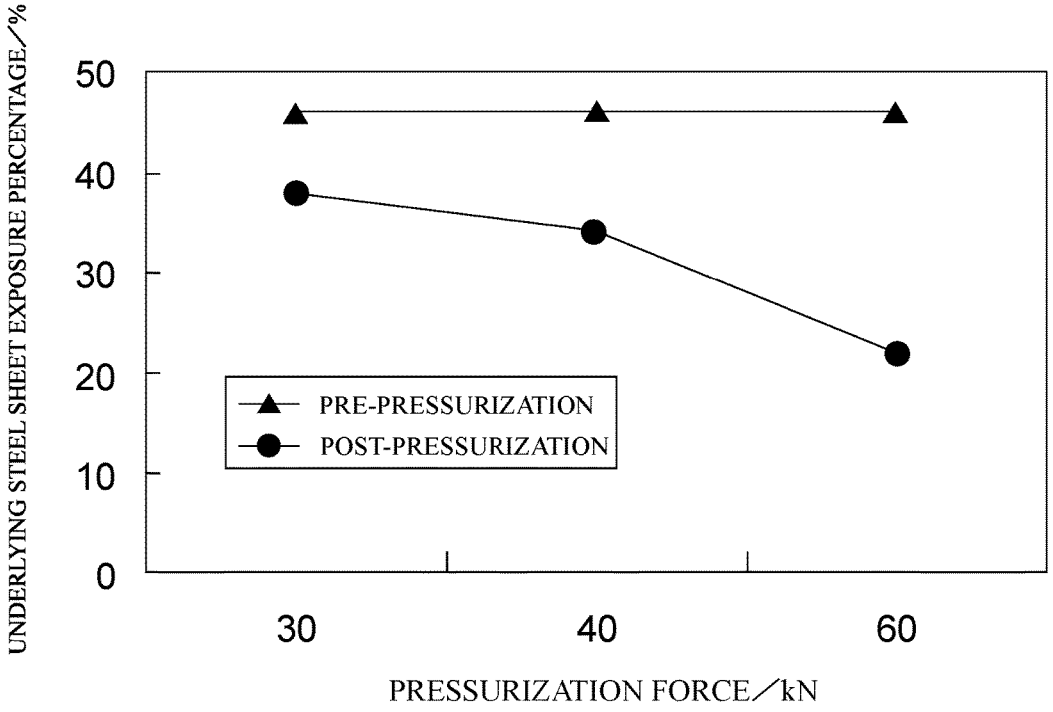
FIG. 3 is a graph showing a relationship between the pressurization force exerted on the worked portion and the surface exposure percentage (i.e., the underlying steel sheet exposure percentage) of the underlying steel sheet after pressurization.

The changes in the underlying steel sheet exposure percentage caused by pressurization are shown in FIG. 3. As indicated by this drawing, it can be inferred that as a result of performing pressurization, the exposure percentage of the underlying steel sheet 7 is decreased, and that the higher the pressurization force, the smaller the exposure percentage becomes and the greater the achieved effect of suppressing the occurrence of red rust is.

Figure 4:
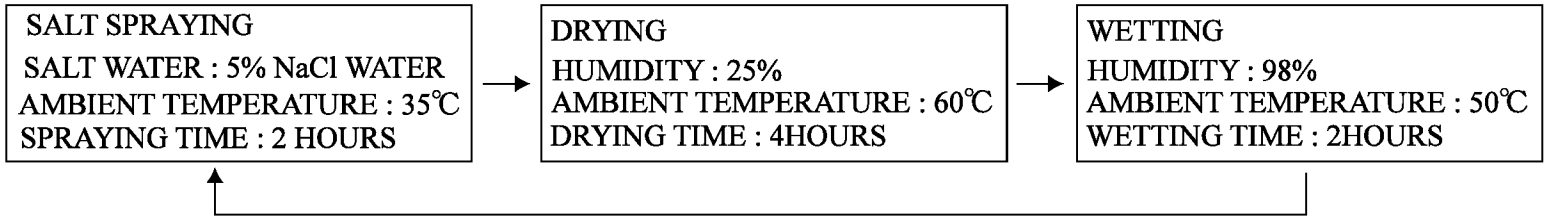
FIG. 4 is a flowchart showing the conditions for a neutral salt spray cycle test.

Further, the workpiece 2 before pressurization and the workpiece 2 pressurized at 30 kN were subjected to a neutral salt spray cycle test, and were evaluated for the corrosion resistance. The conditions for the neutral salt spray cycle test are those shown in FIG. 4. The number of cycles was set to 100.

As a result of the above-described 100-cycle test, red rust occurred from the head portion in the workpiece 2 that had not undergone pressurization. However, no red rust occurred from the head portion of the workpiece 2 in which the head portion was pressurized at 30 kN, so that it was confirmed that the processing method according to the present invention can suppress deterioration in the corrosion resistance of the Zn-based plated workpiece 2.

INDUSTRIAL APPLICABILITY

The processing method of a Zn-based plated workpiece according to the present invention is useful to suppress deterioration in the corrosion resistance, attributed to working cracks in a plated layer caused by plastic working, of a workpiece using a Zn-based plated steel sheet as a raw material, and to maintain good corrosion resistance.

REFERENCE SIGNS LIST

1 Zn-based plated steel sheet
2 workpiece
3 plated layer
4 working cracks (in plated layer)
5 punch
6 die
7 underlying steel sheet
8 pressurization punch
9 pressurization die
10 head portion (of workpiece)
11 vertical wall portion (of workpiece)
12 blank holder

The invention claimed is:

1. A method for processing a Zn-based plated workpiece, the method comprising:

performing plastic working on a Zn-based plated steel sheet to produce a workpiece having a first shape; and performing pressurization processing by applying reduction to a worked portion of the workpiece, the worked portion having a second shape that comprises at least a portion of the first shape, wherein the reduction is applied to the worked portion in a sheet thickness direction by using a processing punch and a processing die having a third shape that follows the second shape of the worked portion such that the plated layer collapses in the sheet thickness direction and expands in an in-plane direction of the plated layer to reduce an interval between working cracks in the plated layer.

2. The method of claim 1, wherein the plated layer comprises an alloy containing Zn, Al, and Mg.

* * * * *